United States Patent [19]

Ting

[11] 4,453,364

[45] Jun. 12, 1984

[54] CORRUGATED STEEL DECKING SECTION

[76] Inventor: Raymond M. L. Ting, 318 Holiday Dr., Pittsburgh, Pa. 15237

[21] Appl. No.: 317,587

[22] Filed: Nov. 3, 1981

Related U.S. Application Data

[63] Continuation-in-part of Ser. No. 153,260, May 27, 1980, abandoned.

[51] Int. Cl.[3] ..... E04C 2/32

[52] U.S. Cl. ..... 52/630; 52/220; 52/450

[58] Field of Search ..... 52/220, 221, 173, 336, 52/450, 451, 630; 174/48, 49, 96, 97, 98

[56] References Cited

U.S. PATENT DOCUMENTS

| | | | |
|---|---|---|---|
| 3,363,379 | 1/1978 | Curran | 52/334 |
| 3,397,497 | 8/1968 | Shea | 52/334 |
| 3,520,100 | 7/1970 | Webb | 52/630 |
| 3,660,482 | 5/1972 | Elizalde | 52/537 |
| 3,760,549 | 9/1973 | Silberkuhl et al. | 52/630 |
| 3,812,636 | 5/1974 | Albrecht | 52/334 |
| 4,085,558 | 4/1978 | Albrecht | 52/630 |

FOREIGN PATENT DOCUMENTS

| | | | |
|---|---|---|---|
| 1176824 | 11/1958 | France | 52/520 |
| 1361487 | 4/1963 | France | 52/220 |
| 0779538 | 11/1980 | U.S.S.R. | 52/336 |

OTHER PUBLICATIONS

Airtherm Catalog 225, Uniform File No. 5p, pp. 1–12.
Roll Form Product Inc., 4/29/75, p. 18.

*Primary Examiner*—Henry E. Raduazo
*Attorney, Agent, or Firm*—Harry B. Keck

[57] ABSTRACT

Improved corrugated steel decking of the type having plural crest surfaces, plural valley surfaces and plural sloping web surfaces connecting each crest surface to the adjoining valley surface. An inwardly depressed groove is provided in each of the sloping web surfaces adjacent to the crest surface.

8 Claims, 7 Drawing Figures

CORRUGATED STEEL DECKING SECTION

CROSS-REFERENCES TO RELATED APPLICATIONS

This application is a continuation-in-part of my copending U.S. patent application Ser. No. 153,260, filed May 27, 1980, now abandoned.

BACKGROUND OF THE INVENTION

1. Field of the Invention

This invention relates to improved corrugated steel floor decking sections of the type which are used to construct floors of modern buildings.

2. Description of the Prior Art

Corrugated steel floor decking has been employed as a construction component for buildings for many years. The corrugated steel floor decking is fastened to the steel framework of a building and constitutes a membrane surface of each floor of a building and serves as a permanent form for subsequently applied concrete. Throughout the life of the building the concrete serves as the walking surface for each floor. In the early building construction days, the steel floor decking served merely to support and shape the wet concrete until it was hardened; consequently the steel decking was not considered as contributing to the strength of the resulting building floor.

Subsequently, variations in the surfaces and profiles of the steel floor decking section permitted the interengagement of concrete and the steel decking section whereby the concrete and steel acted compositely in the resulting building floor. The steel floor decking could be taken into consideration for its contribution as a tensile stress-resisting component and the concrete could be employed for its compressive stress-resisting characteristics. In such composite floor buildings, both the concrete and steel contribute to the ultimate load carrying capability of the building floor.

In order to combine the steel and the concrete as described, indentations, embossments, grooves, ribs and other physical deformations of the corrugated steel decking have been introduced to achieve mechanical interferences with the subsequently poured wet concrete and thereby to assure a positive bonding between the steel decking and the hardened concrete.

All of the prior art composite steel floor decking sections experience a number of shortcomings.

Any composite steel decking experiences three distinct phases of its life history. In the first phase of the life history of the steel decking, the decking is secured to a structural building framework, usually horizontal steel beams which extend between vertical steel columns. The decking sections are assembled in side-by-side relation and engaged with lateral connecting means. The decking sections are secured, usually by welding, to the horizontal beams and serve as a walking surface for various trades in the building construction prior to the pouring of wet concrete on top of the assembled decking sections to establish the building floor. During this first phase, the steel decking sections constitute the only available structural component upon which workmen may walk and move construction vehicles. The steel decking must possess sufficient strength to support the weight of the workmen and anticipated construction traffic.

During the first phase, while the steel decking is in position and before the wet concrete has been poured, the prior art steel decking is susceptible to serious damage which may result from localized impact loads when workmen tread heavily upon corners of the decking or when workmen drop heavy construction tools on the decking.

In the second phase of the lifetime of the steel decking, wet concrete is poured over the entire surface of each floor. The wet concrete makes no contribution to the load-carrying capability of the resulting floor. Accordingly, during the second phase of its lifetime, the steel decking must carry not only its own weight but also the weight of the wet concrete. The ability of steel decking to sustain the load of wet concrete has been characterized as the "wet strength" of the decking. Where the "wet strength" of the decking is inadequate to sustain the weight of wet concrete over the span, it is customary to provide props or shoring to supplement the load-carrying capability of the decking. The inconvenience and expense of such shoring has been a serious shortcoming of many prior art steel decking sections.

The third phase of the life of the steel decking commences after the wet concrete has hardened and the hardened concrete is combined with the steel decking as a composite floor structure. During this third phase, a good mechanical bond exists between the hardened concrete and the steel decking.

SUMMARY OF THE INVENTION

The present invention concerns an improvement in corrugated steel decking which includes plural crest surfaces, plural valley surfaces and plural sloping web surfaces connecting the edges of each crest surface to the adjacent valley surface. It is a characteristic of all corrugated steel decking that the crest surfaces have a width which is greater than the spacing between the common plane of the crest surfaces and the common plane of the valley surfaces. I provide a lengthwise, uninterrupted groove along the length of the decking section near the top of each sloping web surface. Each groove enters beneath the crest surface. The outer edges of each crest surface are positioned above the sidewall grooves. Planes normal to the crest surfaces at the outer edges of the crest surfaces will intersect the groove and not the sloping web surfaces.

1. The decking has an improved impact resistance since the groove provides resistance to top flange corner buckling. Thus the decking is less susceptible to damage during its first phase from dropping construction tools or from construction traffic.

2. The effective length of each sloping web surface is shortened, and, as a result, the web crippling strength of the steel decking is increased. This feature increases the wet strength of the steel decking in phase two.

3. The grooves establish an excellent bond between the concrete and the steel decking in the region of the decking crest surfaces where the shear stresses between the concrete and the steel decking are maximized. This feature increases the load carrying capability of the resulting composite flooring in phase three.

4. A further benefit arises in those instances where the steel decking is employed in the form of cellular steel decking and the crest surfaces are provided with access openings for electrification purposes. With prior art cellular steel decking, the crest surface access openings created significant loss of strength in the steel decking—in some cases requiring the use of heavier gauge decking or requiring shorter spans. The lengthwise grooves of this invention greatly increase the strength of the decking crest region and effectively offset the loss of strength which would otherwise arise from crest access openings.

DESCRIPTION OF THE PREFERRED EMBODIMENTS

Figure 1:
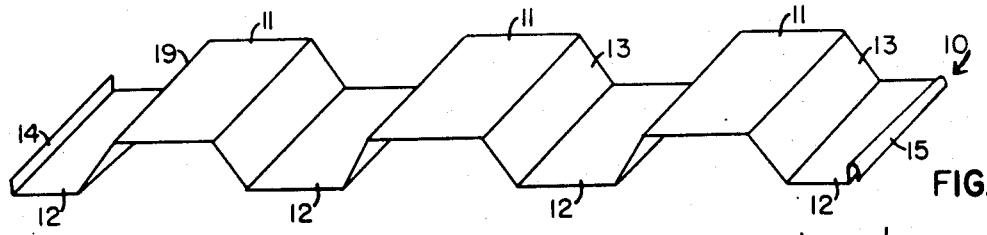
FIGS. 1, 2, 3 are perspective sketches of typical corrugated steel decking sections of the prior art.

Referring to FIG. 1, a steel floor decking section of the type described in U.S. Pat. No. 3,363,379 is illustrated. Decking section 10 includes crest surfaces 11, valley surfaces 12 and sloping web surfaces 13. All of the surfaces 11, 12, 13 are flat and essentially undeformed. Section 10 also includes lateral connecting flange 14 and connecting groove 15 for assembling the sections 10 in side-by-side interlocked relationship.

Figure 2:
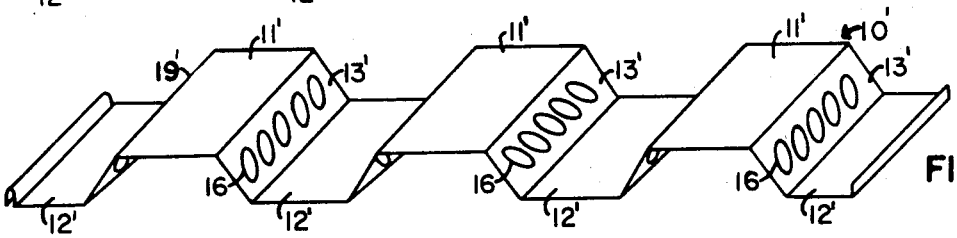

The similar section 10' of FIG. 2 corresponds to floor decking sections illustrated in U.S. Pat. No. 3,397,497 including unindented crest surfaces 11', unindented valley surfaces 12', and deformed web surfaces 13' which are provided with multiple indentations or embossments 16 which may be obliquely oriented finger-shaped deformations as shown or may take a variety of other geometric shapes. The function of the web deformations 16 is to achieve a good bond between subsequently poured concrete and the steel decking. The corrugated steel decking of FIG. 3 corresponds to that illustrated in Canadian Pat. No. 704,839 wherein the decking 10" includes crest surfaces 11", unindented valley surfaces 12", and sloping web surfaces 13". The crest surfaces 11" are equipped with multiple parallel deformations whose function is to increase the shear transfer capability of the resulting composite floor—that is, the floor resulting from the combination of the steel decking 10" and subsequently poured concrete. The sloping sidewalls 13" are provided with multiple deformations 18 which are indentations or grooves functioning to improve the bond between the steel decking and the concrete in the resulting composite floor.

Figure 3:
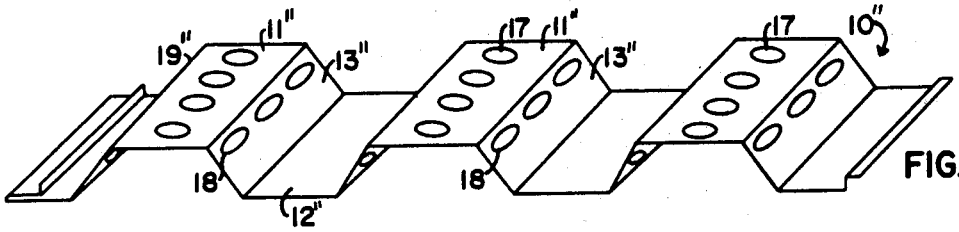

All of the decking sections of FIGS. 1, 2 and 3 are susceptible to damage along the top flange corner indicated by the numeral 19, 19', 19" in FIGS. 1, 2, 3, respectively. It will further be observed that the sloping web surfaces 13, 13', 13" extend between the crest surfaces 11, 11', 11" and the valley surfaces 12, 12', 12". The entire length of the web surfaces 13, 13', 13" are susceptible to web crippling.

Figure 4:
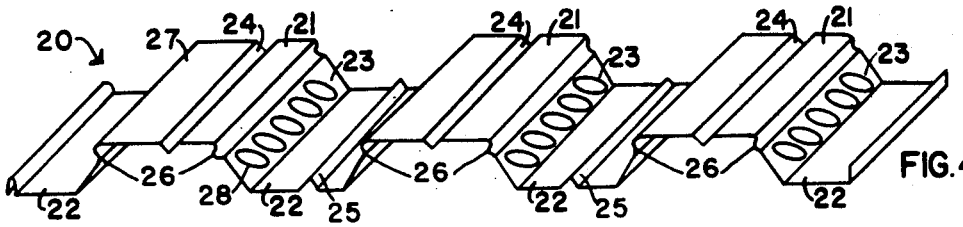
FIG. 4 is a perspective sketch of a corrugated steel decking section according to the present invention.

The steel decking section of this invention, as shown in FIG. 4, includes crest surfaces 21, valley surfaces 22 and sloping web surfaces 23. A lengthwise groove 24 is depressed into the crest surface 21. A bead 25 is formed in each intermediate valley surface 22. A lengthwise groove 26 is provided in each sloping web surface adjacent to the top flange corner 27. The decking section 20 has a number of raised flutes, each such raised flute being formed from a crest surface 21 and the two contiguous sloping web surfaces 23. The beads 26 are indented into the raised flute structure.

The sloping webs 23 have an essentially flat lower portion which is provided with multiple deformations 28 which are preferably in the form of finger-shaped indentations which are aligned in parallel relation to one another.

Figure 5:
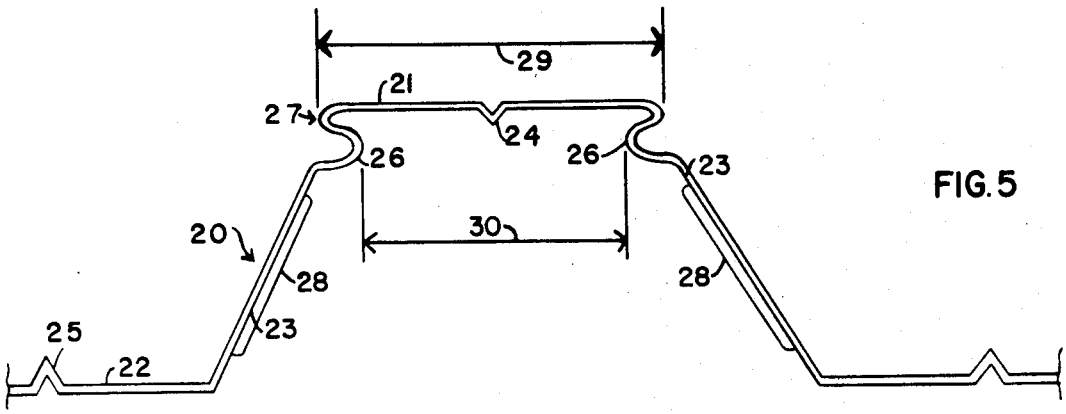
FIGS. 5 and 6 are fragmentary cross-section views of a portion of the steel decking section of this invention.

The crest surface 21 has a width indicated by the dimension line 29 in FIG. 5. The inner surfaces of the grooves 26 are spaced apart by the distance 30. It will be observed that the dimension 30 is less than the dimension 29. The top flange corner 27 preferably has a bending radius of about 3–10 mm. The groove 26 preferably has a depth of about 5–15 mm.

Typically steel decking sections are fabricated from hot or cold rolled steel sheets, frequently galvanized steel sheets, of 22 gauge to 16 gauge thickness. The steel decking sections normally have a width of 60 to 300 cm and a height, between crest surfaces and valley surfaces, of 35 to 100 mm.

Figure 6:
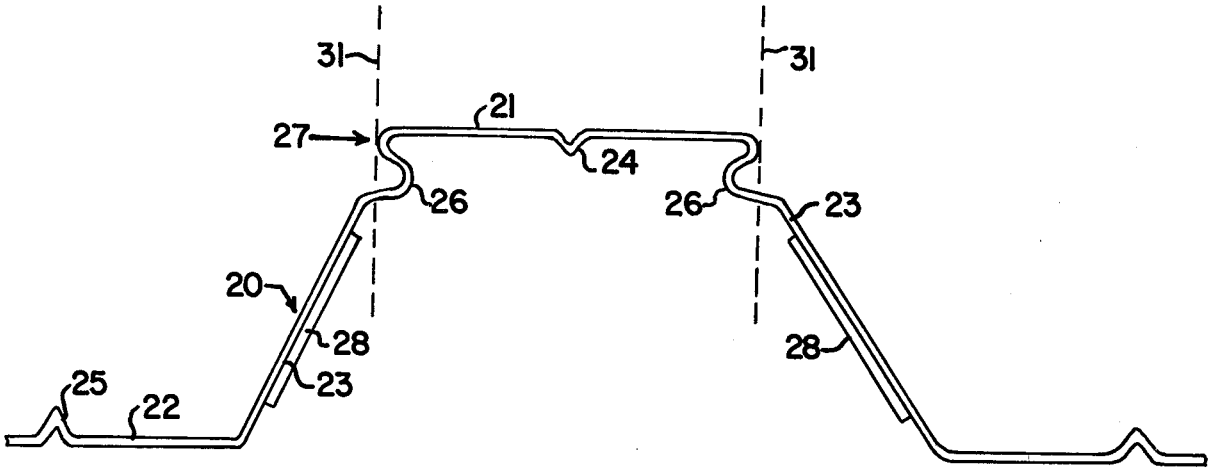

FIG. 6 also illustrates the present floor decking section. Two planes 31 are illustrated as broken lines extending normally from the outer edges of the crest surface 21. It will be observed that the planes 31 pass through the groove 26 and are inside the sloping wall surfaces 23, i.e., the planes 31 do not intersect the sloping wall surfaces 23. As a consequence of this arrangement, any blow applied to the edge 27 tends to collapse that edge rather than to collapse a sloping wall surface 23.

Figure 7:
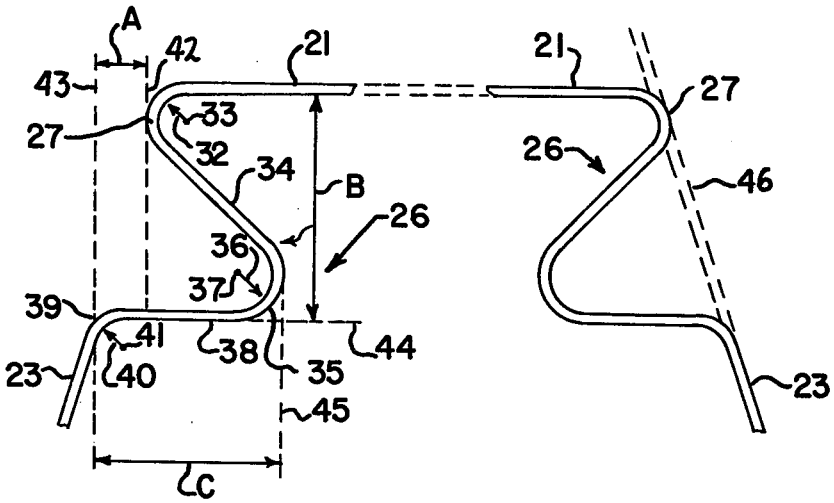
FIG. 7 is a fragmentary cross-section view of a portion of a preferred embodiment of the steel floor decking section of this invention.

A preferred embodiment of the floor decking is illustrated in FIG. 7 where the top corner flange 27 is formed by curving a radius 32 about an axis 33. The groove 26 further includes a generally flat surface 34 which joins another arcuate surface 35 formed by a radius 36 about an axis 37. A further generally flat horizontal surface 38 extends outwardly and connects with the sloping sidewall 23 through an arcuate surface 39 which is formed by a radius 40 about an axis 41. The radii 32, 37, 40 preferably are about 3–5 mm.

It will further be observed from FIG. 7 that the outer edge of the top corner flange 27 is displaced inwardly from the arcuate surface 39 by a distance A. The actual distance A between two lines 42, 43 is about 5 mm in a preferred embodiment. The line 42 is normal to the surface of the crest 21 and extends through the outer surface of the top corner flange 27. The line 43 similarly is normal to the surface of the crest 21 and extends through the intersection of the surface 38 and the sloping wall surface 23.

The horizontal surface 38 lies in a plane 44 which is separated from the undersurface of the crest 21 by a distance B which is preferably about 19–20 mm.

A plane 45 passes through the inner surface of the arcuate surface 35 normal to the surface of the crest 21. The distance C between the planes 43, 45 is about 14–15 mm in a preferred embodiment. The total height of the preferred embodiment of the deck can be from 1½ to about 4 inches. The distance between the crest 21 and valley 22 is about 1½ to about 4 inches, or 38 to 100 mm.

By employing a profile as shown in FIG. 7, the properties of a 3-inch floor deck and a 2-inch floor deck have been established. In each floor deck, the section had a 30-inch total width and included two crests, each 6 inches wide; an intermediate valley in the center; and an intermediate valley on each side of the crests. The 30-inch width 3-inch deck had a girth/coverage factor of 17.4 inches per foot. The 2-inch deck had a girth/coverage ratio of 16.15 inches per foot. The structural properties of the two different decks are set forth in the following table.

FIG. 7 also shows in broken lines an extension 46 of the sloping wall surface 23. The extension 46 lies in the plane of the sloping web surface 23 and intersects the plane of the crest 21 at or outside the adjacent side edge of the crest.

STRUCTURAL PROPERTIES OF STEEL DECKING

| STEEL THICKNESS GAUGE | I [1] | S(t) [2] | S(b) [3] | I [4] | S(t) [5] | S(b) [6] |
|---|---|---|---|---|---|---|
| (A) Three-inch deck | | | | | | |
| 22 | 0.781 | 0.419 | 0.583 | 0.719 | 0.480 | 0.419 |
| 20 | 0.973 | 0.533 | 0.706 | 0.901 | 0.582 | 0.538 |
| 18 | 1.346 | 0.778 | 0.955 | 1.293 | 0.790 | 0.799 |
| 16 | 1.683 | 1.016 | 1.199 | 1.672 | 1.002 | 1.101 |
| (B) Two-inch deck | | | | | | |
| 22 | 0.322 | 0.247 | 0.372 | 0.288 | 0.286 | 0.246 |
| 20 | 0.403 | 0.317 | 0.451 | 0.363 | 0.348 | 0.319 |
| 18 | 0.560 | 0.467 | 0.610 | 0.528 | 0.472 | 0.481 |
| 16 | 0.700 | 0.612 | 0.765 | 0.692 | 0.600 | 0.675 |

NOTES
[1] = Moment of Inertia, (inches)$^4$
[2] = *Section Modulus, top flange (inches)*3
[3] = *Section Modulus, bottom flange (inches)*3
[4] = *Moment of Inertia, (inches)*$^4$-negative
[5] = Section Modulus, top flange (inches)$^3$-negative
[6] = Section Modulus, bottom flange (inches)$^3$-negative

Advantages of the Invention

It will be observed that the top flange corner 27 of the present decking section has a spring-like character as a result of the penetration of the groove 26 into the area beneath the crest surface 21. Hence any impact blow applied to the top flange corner 27 will be readily absorbed by the structure without causing serious damage to the steel decking.

It is well known in composite floor technology that the shear stresses between the corrugated steel decking and the subsequently applied concrete covering material are maximized in the region just beneath the crest surface 21. With the decking section of this invention, the groove 26 provides a greatly increased surface bonding capability for the concrete in the region where maximum shear stresses can be anticipated. As a result, the present decking section will develop superior strength properties in composite floors.

The concentration of steel in the top flange corner 27 functions to stiffen and to strengthen the decking section in that region. As a consequence, the decking section of this invention has superior wet strength properties when compared with corrugated steel decking sections of the prior art. Furthermore, the stiffening contribution of the bead 26 in its location adjacent to the top corner flange 27 will stiffen the crest surface 21 and will permit cutting access openings in the crest surface 21 without significantly reducing the structural properties of the decking section.

The present invention greatly improves the web crippling characteristics of the decking section. In general, the load carrying capability of the decking section is determined by the vertical distance between the crest surface 21 and the valley surface 22. The web crippling tendency of the sloping webs 23 is determined by their flat length. Referring to FIG. 5, it will be observed that the flat length of the web surfaces 23 is considerably less than the distance between the valley surface 22 and the crest surface 21 along the plane of the web surface 23. The shortening of the flat web surface results from locating the grooves 26 in accordance with this invention. Thus the decking section has the strength resulting from spacing the valley surfaces 22 and crest surfaces 21 without having the normally accompanying decreased web crippling strength.

I claim:

1. In a steel floor decking section comprising a profiled steel sheet having plural crest surfaces in a common crest plane, plural valley surfaces in a common valley plane and sloping web surfaces connecting each said crest surface to the adjoining valley surface, whereby each said crest surface and its contiguous sloping web surfaces form a raised flute, the said crest surfaces being a width greater than the spacing between the said crest plane and the said valley plane;

lateral connecting means disposed along each of the outer ones of said valley surfaces of said decking section;

the improvement comprising a lengthwise groove which is uninterrupted for the length of the decking section and enters beneath the said crest surface in each of the said sloping web surfaces adjacent the top of said raised flute, wherein a flat plane which includes the said sloping surface intersects the said crest plane at or outside the adjacent side edge of the crest.

2. The steel decking section of claim 1 wherein said groove has a depth of 5 to 15 mm.

3. The decking section of claim 1 wherein the distance between the inner surfaces of the two said grooves of each said raised flute are spaced apart by a distance which is less than the width of the included crest surface.

4. The steel decking section of claim 1 wherein each of said valley surfaces has an upstanding bead extending along the length of the decking section.

5. The steel decking section of claim 1 wherein each said crest surface has a longitudinal stiffening bead extending into the said raised flute.

6. The decking section of claim 1 wherein the said sloping web surfaces are essentially flat surfaces between the said groove and the contiguous valley surface and wherein plural metal deformations in the form of indentations or embossments are provided over the flat portion of said web surfaces.

7. In a steel floor decking section comprising a profiled steel sheet having plural crest surfaces in a common crest plane, plural valley surfaces in a common valley plane and sloping web surfaces connecting each said crest surfaces to the adjoining valley surface, whereby each said crest surface and its contiguous sloping web surfaces form a raised flute, the said crest surfaces having a width greater than the spacing between the said crest plane and the said valley plane;

lateral connecting means disposed along each of the outer ones of said valley surfaces of said decking section;

the improvement comprising a lengthwise groove which is uninterrupted for the length of the decking section in each of the said sloping web surfaces adjacent the top of said raised flute, the said groove being inwardly disposed beneath the said crest surface such that a plane normal to the said crest surface at the edge of said crest surface will intersect the said groove and will not intersect the said sloping wall surface.

8. The decking section of claim 1 wherein the said groove comprises a first downwardly curved surface at the side of each said crest, connecting with an inwardly, downwardly sloping flat surface, a second outwardly curved surface, an outwardly directed flat surface and a downwardly curved surface which joins the adjacent said sloping sidewall surface.

* * * * *